US007661973B2

(12) United States Patent
Lee et al.

(10) Patent No.: US 7,661,973 B2
(45) Date of Patent: Feb. 16, 2010

(54) CARD EDGE CONNECTOR POSITIONING APPARATUS

(75) Inventors: Kuo-Chi Lee, Taipei County (TW); Shih-Chia Lai, Taipei County (TW)

(73) Assignee: Dragonstate Technology Co., Ltd., Taipei (TW)

( * ) Notice: Subject to any disclaimer, the term of this patent is extended or adjusted under 35 U.S.C. 154(b) by 0 days.

(21) Appl. No.: 12/125,323

(22) Filed: May 22, 2008

(65) Prior Publication Data

US 2009/0029566 A1 Jan. 29, 2009

(30) Foreign Application Priority Data

Jul. 27, 2007 (TW) ..... 96212294 U

(51) Int. Cl.
*H01R 13/62* (2006.01)

(52) U.S. Cl. ..... 439/326

(58) Field of Classification Search ..... 439/326–328, 439/761, 946; 361/737, 800
See application file for complete search history.

(56) References Cited

U.S. PATENT DOCUMENTS 3,932,016 A * 1/1976 Ammenheuser ..... 439/377
5,290,174 A * 3/1994 Woratyla et al. ..... 439/59
5,690,502 A * 11/1997 Mochizuki ..... 439/320
5,695,354 A * 12/1997 Noda ..... 439/326
5,755,585 A * 5/1998 Cheng et al. ..... 439/326
5,779,494 A * 7/1998 Ito et al. ..... 439/326
5,803,761 A * 9/1998 Mochizuki ..... 439/326
5,833,478 A * 11/1998 Tseng et al. ..... 439/326
6,024,592 A * 2/2000 Pai et al. ..... 439/326
6,027,357 A * 2/2000 Howell et al. ..... 439/326
6,030,245 A * 2/2000 Choy ..... 439/328
6,042,411 A * 3/2000 Choy ..... 439/328
6,164,998 A * 12/2000 Poi et al. ..... 439/326
6,796,825 B2 * 9/2004 Wang ..... 439/326
6,843,663 B2 * 1/2005 Lee ..... 439/92
7,074,067 B2 * 7/2006 Yang et al. ..... 439/326
2004/0248451 A1 * 12/2004 Lee ..... 439/328
2005/0048828 A1 * 3/2005 Ho et al. ..... 439/326
2005/0136724 A1 * 6/2005 Lin ..... 439/326
2006/0094277 A1 * 5/2006 Yang et al. ..... 439/328

* cited by examiner

*Primary Examiner*—T C Patel
*Assistant Examiner*—Harshad C Patel
(74) *Attorney, Agent, or Firm*—Rosenberg, Klein & Lee

(57) ABSTRACT

A card edge connector positioning apparatus has a first retaining trough, a second retaining trough and a support member. The first retaining trough is closer to a distal end of the positioning apparatus than the second retaining trough. The support member has a first edge and a second edge at two opposite sides. The first edge is wedged in the first retaining trough to form a movement fulcrum. The second edge is held in the second retaining trough to form a gap greater than that of the first edge in the first retaining trough. Thus the second edge has a greater displacement in the second retaining trough than that of the first edge in the first retaining trough. Thereby a displacement space for installation tolerance is formed for the support member.

15 Claims, 6 Drawing Sheets

CARD EDGE CONNECTOR POSITIONING APPARATUS

FIELD OF THE INVENTION

The present invention relates to a card edge connector positioning apparatus located at one side of a memory slot to clip and anchor a memory.

BACKGROUND OF THE INVENTION

Computer operation has to rely on random access memory (RAM) to retrieve and save data. Most computers have memory slots to engage with pluggable RAMs (commonly called memory, and will be thus named hereinafter). The memory has to be positioned and anchored securely to prevent moving and poor contact, access errors or damage. A conventional memory slot has a pair of positioning means to clip the memory to prevent it from swaying. The memory slot has a plurality of pins extended outside to connect to a circuit board. The positioning means has a lower edge which must be kept at the same horizontal level of the pins to achieve correct installation. Hence manufacturing tolerance of the positioning means and the pins has to be controlled within a very small range. This creates production problem.

Another conventional memory slot discloses a positioning apparatus located at two sides of a memory slot to clip two sides of a memory. The positioning apparatus is made from plastics by injection. It is disposed at two sides of the memory slot. As tolerance is unavoidable during fabrication, the precision of the two positioning apparatus varies. Moreover, the positioning apparatus are flexible, frequent insertion and removing of the memory often cause positional change of the positioning apparatus, and a permanent deformation takes place when subject to external forces like this. All this creates errors and affects memory positioning.

Another conventional memory slot discloses a positioning technique that allocates a spared space between the memory slot and a positioning means to alleviate the difficulty of aligning the positioning means and the pins at the same horizontal level. The positioning means has a room for moving up and down before being mounted onto a circuit board. Such a design makes manufacturing tolerance acceptable and can keep the lower edge of the positioning means and the pins at the same horizontal level. However, the spared room, aside from allowing the positioning means to be moved up and down, also makes it swayable left and right. This makes insertion of the memory difficult. Defects increase. There is still room for improvement for the structure of positioning the memory.

SUMMARY OF THE INVENTION

In view of the aforesaid drawbacks occurred to the conventional techniques, the primary object of the present invention is to provide a positioning structure for memory to enhance anchoring and alleviate deformation of the positioning apparatus under forces.

The present invention provides a card edge connector positioning apparatus that is mounted onto two sides of a memory slot. The positioning apparatus includes an anchor member and a support member. The anchor member is extending along a extending direction and has a distal end away from the memory slot. The support member comprises a support portion and an extended portion. The support portion is used for support the anchor member, and the support portion has a fixing end for fixing the circuit board. The extended portion is extended along the extending direction from the support portion, and the extended portion is pivoted with the distal end of the anchor member. Rotating the anchor member can change the distance between the fixing end and the anchor member.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
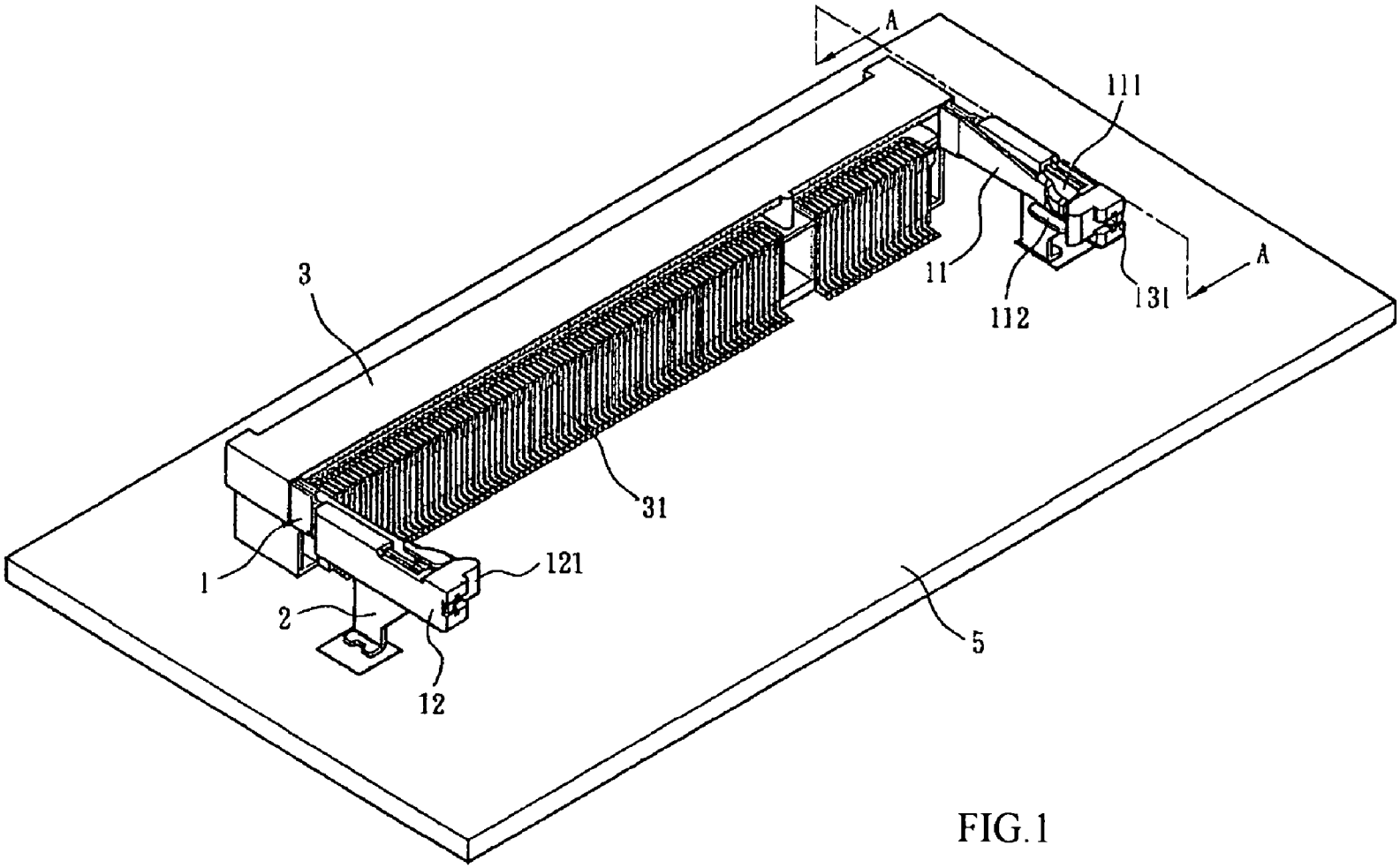
FIG. 1 is a perspective view of a memory slot and the positioning apparatus of the invention.
Figure 2:
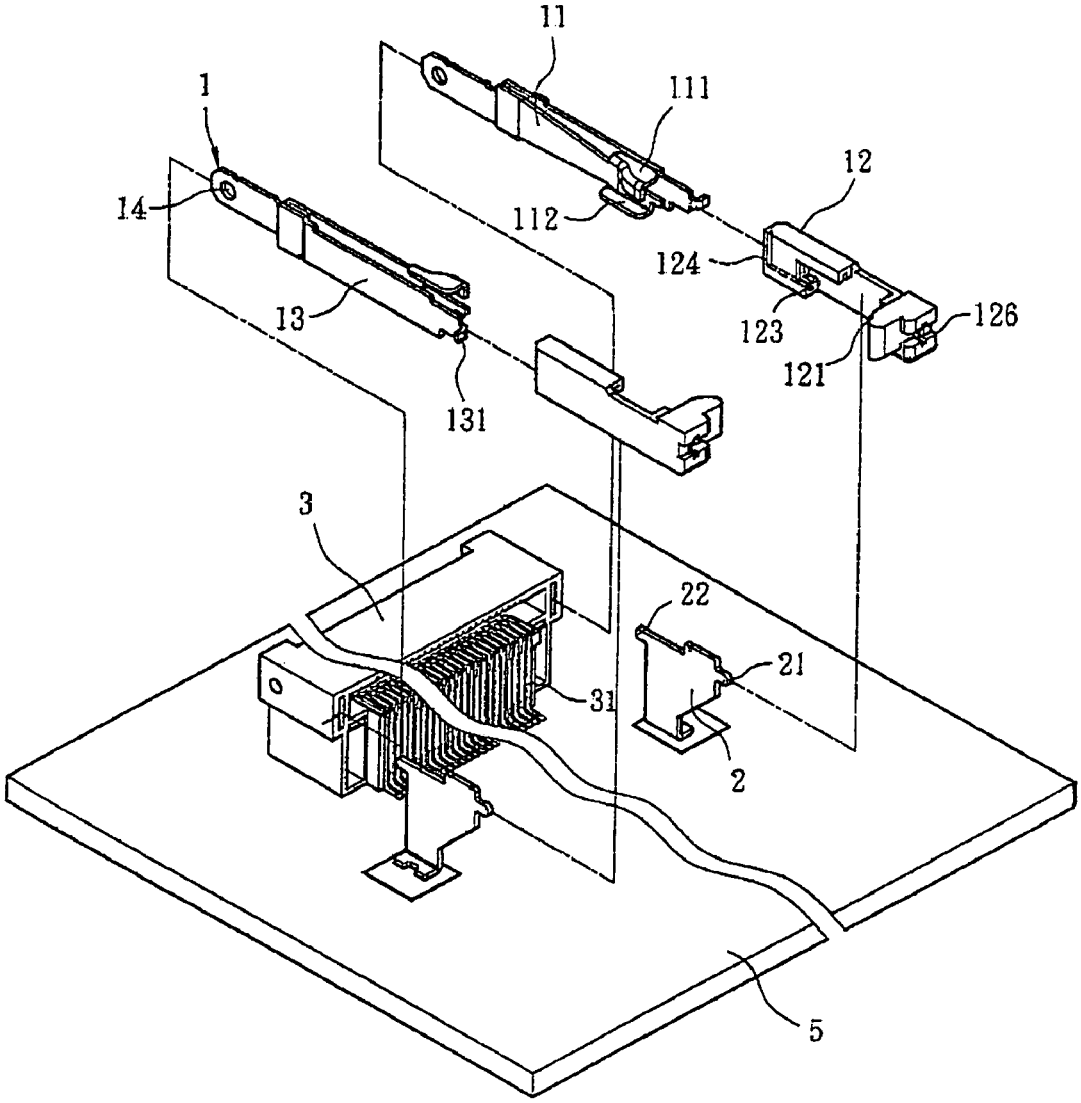
FIG. 2 is an exploded view of the positioning apparatus of the invention.
Figure 3:
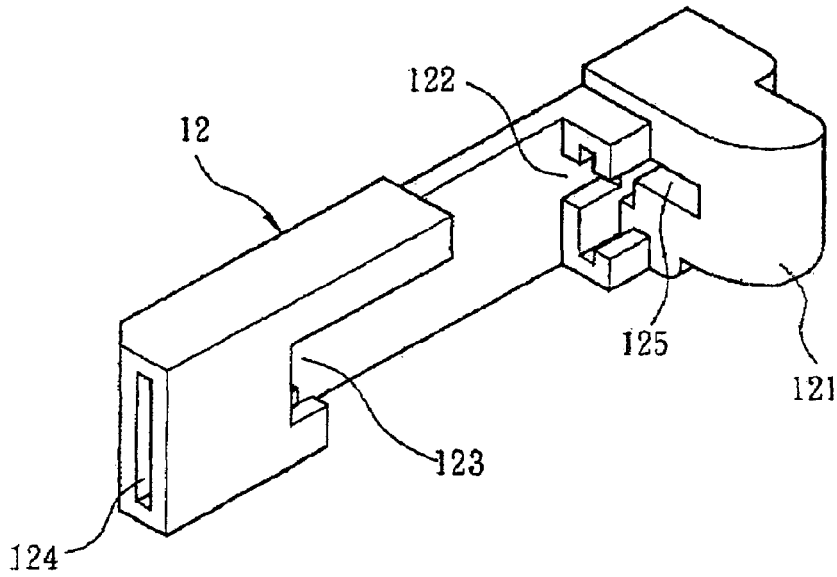
FIG. 3 is an enlarged view of an anchor member.
Figure 4:
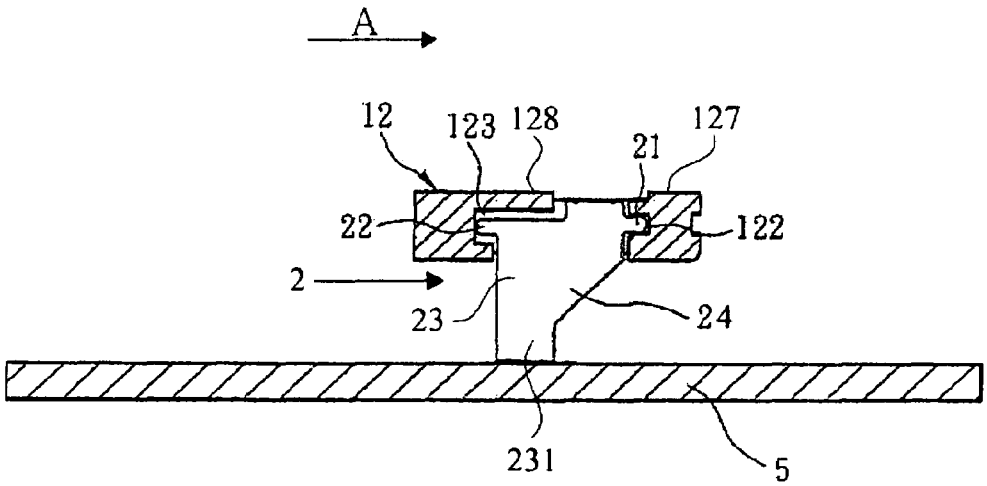
FIG. 4 is a cross section taken on line 4-4 in FIG. 1.

Please refer to FIGS. 1 through 4 for an embodiment of the invention. The positioning apparatus 1 of the invention is mounted at two sides of a memory slot 3. The positioning apparatus 1 has a fastening hole 14 to be fastened to the memory slot 3 to form a secured anchoring without swaying. One end of the positioning apparatus 1 is fixed with the memory slot 3. The memory slot 3 is located on a circuit board 5. The memory slot 3 has a plurality of pins 31. The positioning apparatus 1 has a first anchor arm 11, an anchor member 12, a second anchor arm 13 and a support member 2. The first anchor arm 11 is located close to an inner side of the second anchor arm 13 and faced the memory slot 3 to firmly confine a memory 4 (not shown in FIGS. 1-4) inserted in the memory slot 3. The first anchor arm 11 has a distal end which has a longitudinal retaining portion 111 and a longitudinal support portion 112 that form an elevation difference between them so that a space is formed between the longitudinal retaining portion 111 and the longitudinal support portion 112 to hold the memory 4, and also confine the longitudinal movement of the memory 4 in the memory slot 3. One end of the first anchor arm 11 is deposed in a second aperture 125 of the anchor member 12 preventing the first anchor arm 11 from bending.

The second anchor arm 13 is located at an outer side of the positioning apparatus 1. The second anchor arm 13 has a distal end running through a first aperture 124 and a second aperture 125 formed on the anchor member 12 to fixedly hold the anchor member 12 on the second anchor arm 13. The second anchor arm 13 has a distal end formed a latch hook 131 to run through the second aperture 125 to retain the anchor member 12. The anchor member 12 may have a latch trough 126 to form a secured retaining relationship with the latch hook 131. The distal end of the anchor member 12 also has a transverse anchor element 121 formed thereon to anchor the memory 4.

The anchor member 12 is extending along an extending direction A and has a distal end 127 away from the memory slot 3. The anchor member 12 has a first retaining trough 122 and a second retaining trough 123 at an inner side. The first retaining trough 122 is closer to the distal end 127 of the anchor member 12 than the second retaining trough 123. The space of the first retaining trough 122 and the second retaining trough 123 is slightly greater than the first edge 21 and the second edge 22.

The support member 2 is interposed between the second anchor arm 13 and the anchor member 12. The support member 2 has a support portion 23 and an extended portion 24. The support portion 23 is used for support the anchor member 12, and the support portion 23 has a fixing end 231 for fixing the circuit board. The extended portion 24 is extended along the extending direction A from the support portion 23, and the extended portion 24 is pivoted with the distal end 127 of the anchor member 12. Rotating the anchor member 12 can change the distance between the fixing end 231 and the anchor member 12. Therefore, it can prevent the problem that the fixing end 231 can not weld with circuit board 5 by the displacement between the anchor member 12 and the circuit board 5. The anchor member 12 further has a blocking portion 128 for blocking the rotation of the support member 2.

The support member 2 has a first edge 21 and a second edge 22 at two opposite sides. The first edge 21 can deposed on the extended portion 24, and the second edge 22 can deposed on the support portion 23. The first edge 21 is wedged in the first retaining trough 122 to form a small tolerance and become a movement fulcrum or a rotation fulcrum. The rotation fulcrum can be a rotation axis of the support member 2. Therefore, the first edge 21 is wedged in the first retaining trough 122 to form a rotation axis of the support member 2. The second edge 22 is movably deposed in the second retaining trough 123, and is held in the second retaining trough 123 to form a greater tolerance than that of the first edge 21 and the first retaining trough 122. Hence the second edge 22 in the second retaining trough 123 has a displacement greater than that of the first edge 21 in the first retaining trough 122. Therefore the support member 2 has a movement allowance to accommodate installation tolerance. As a result, before the support member 2 is fixedly mounted onto the circuit board 5 the relative elevation of the positioning apparatus 1 and the circuit board 5 can be adjusted. The support member 2 also can confine the transverse moving range of the positioning apparatus 1 and the second anchor arm 13. In the event that the positioning apparatus 1 has a tolerance and results in the distal end thereof positioned at an unintended horizontal elevation, by deploying the allowance of the second edge 22 and the second retaining trough 123 smooth installation can still be accomplished. Thus a secured card edge connector positioning can be achieved. Through the transverse anchor element 121 at the distal end of the anchor member 12 the memory 4 can be anchored as desired.

Figure 5A:
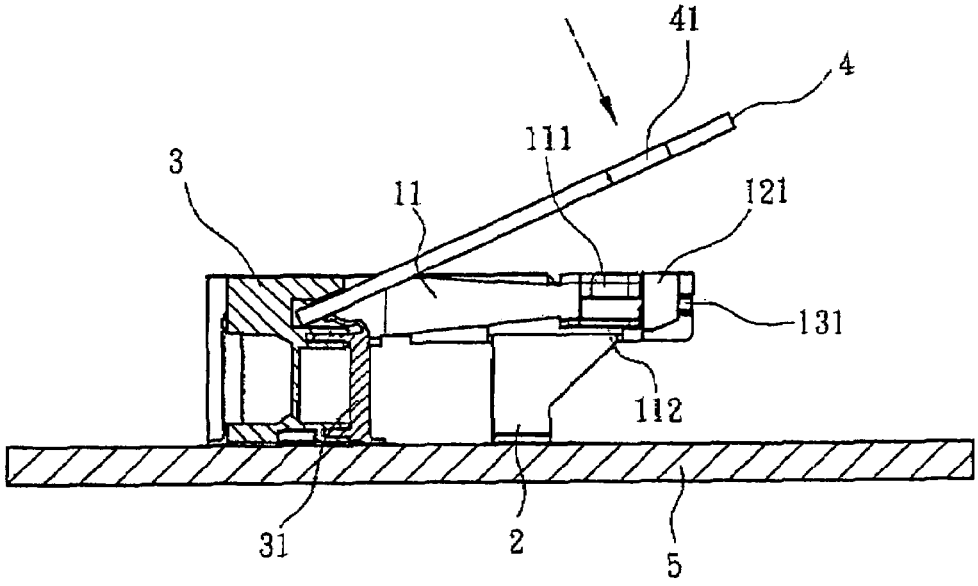
FIG. 5A is a side view showing a memory inserted for positioning.
Figure 5B:
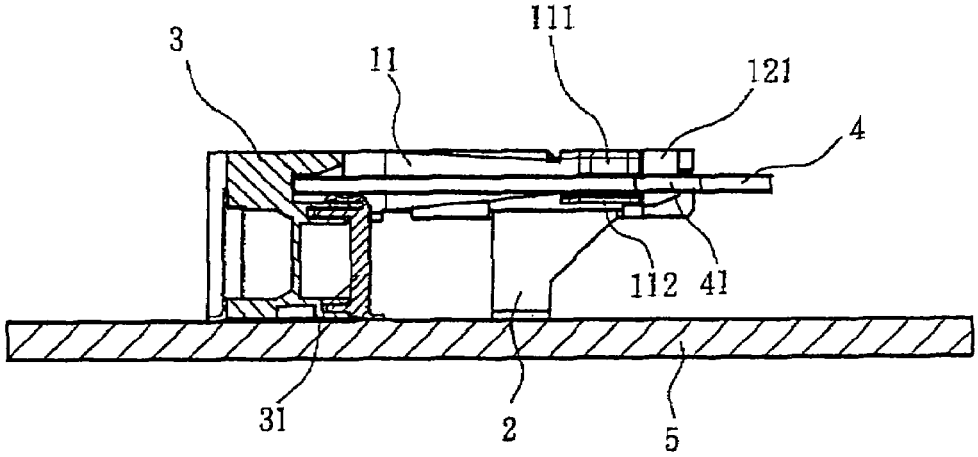
FIG. 5B is a side view showing the memory in an inserted and anchored condition.

Referring to FIGS. 5A and 5B, the memory 4 is inserted in a tilted manner in the memory slot 3 to be in contact with the pins 31. Then the memory 4 is moved downwards to be latched on the positioning apparatus 1. During such a process the first anchor arm 11 is moved slightly outwards to allow the memory 4 to be depressed and wedged at an anchor position. Afterward, the first anchor arm 11 returns quickly to its original position to clip the memory 4 between the longitudinal retaining portion 111 and the longitudinal support portion 112. And the transverse anchor element 121 of the anchor member 12 is latched in a notch 41 formed respectively at two sides of the memory 4 to restrict the sideward moving displacement of the memory 4. Thereby poor contact caused by moving and wearing can be prevented for the memory 4 and the pins 31.

Figure 6A:
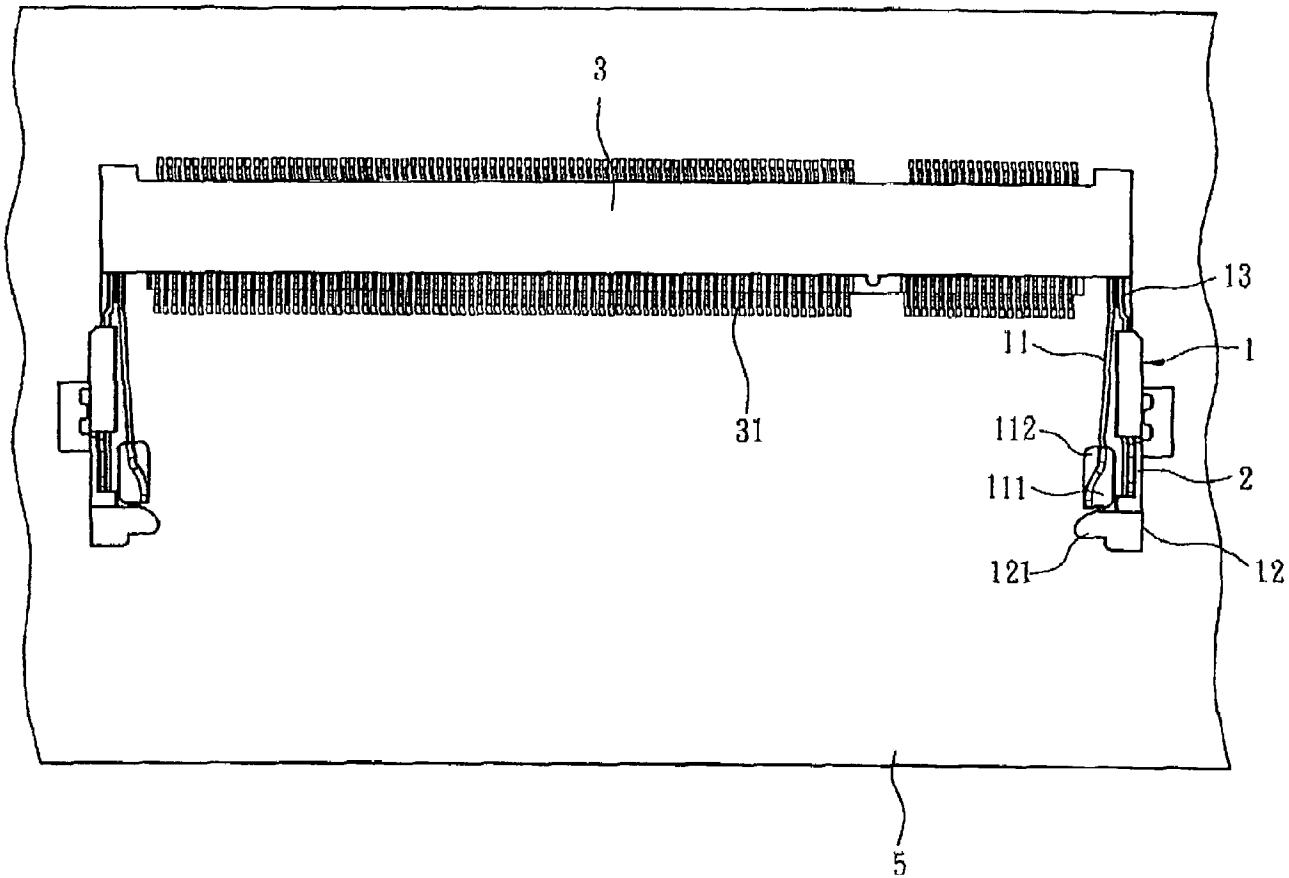
FIG. 6A is top view of the memory slot and the positioning apparatus.
Figure 6B:
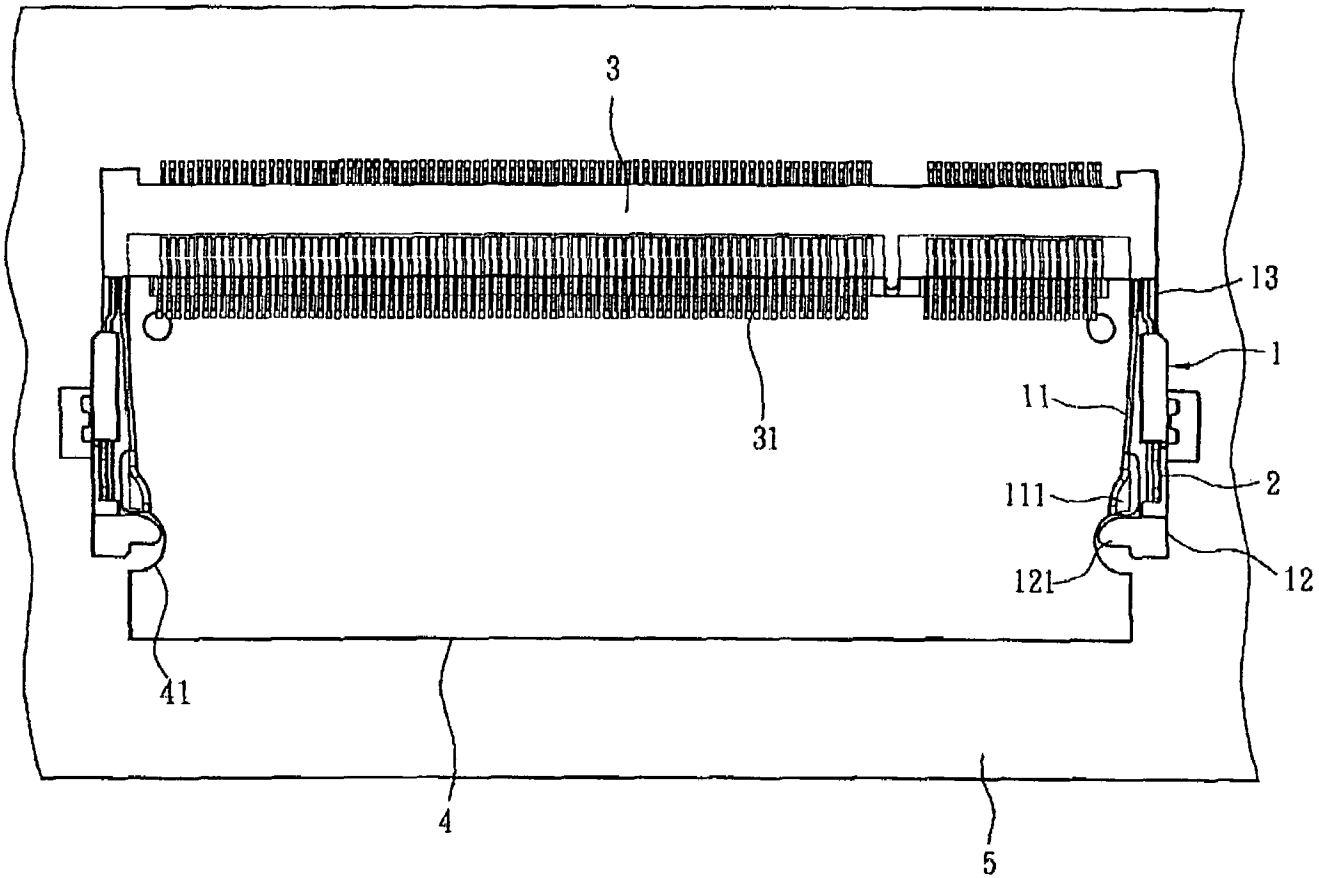
FIG. 6B is top view of a memory in an anchored condition.

Referring to FIGS. 6A and 6B, the support member 2 is located between the second anchor arm 13 and the anchor member 12 so that it is confined from moving transversely. Thereby the positioning apparatus 1 cannot be moved longitudinally or transversely to prevent deformation under external forces. As shown in FIG. 6B, when the memory 4 is inserted in the memory slot 3, as the first anchor arm 11 is elastic and flexible, it can be slightly extended outwards while the memory 4 is inserted and depressed, and returns to its original position when the memory 4 is anchored so that movement of the memory 4 is confined. Compared with the conventional positioning structure in which an integrated rod is fixed on the memory 4 and the integrated rod is extended during insertion and removing of the memory 4 that generate a gap between the root of the rod and the memory slot 3 or material fatigue after repeatedly uses and result in damage, the invention needs only to move the first anchor arm 11 during insertion or removing of the memory 4, and the root of the positioning apparatus 1 does not deform because of material fatigue under forces, thus has a longer durability. In addition, precision for assembly and installation of the positioning apparatus 1 of the invention also improves. Compared with the conventional techniques in which the positioning apparatus is fastened to the memory slot 3, insertion of the memory 4 is easier in the invention because there is no sideward movement as the conventional does. Moreover, by forming the movement fulcrum through the first edge 21 of the support member 2 and the first retaining trough 122 and a displacement between the second edge 22 and the second retaining trough 123, the support member 2 can be moved to compensate the bending tolerance of the positioning apparatus 1 or the circuit board 5. Hence the support member 2 is easier to be positioned at the same horizontal level as the pins 31 do. Assembly and installation are easier and manufacturing tolerance can be offset. Production yield also improves. Furthermore, by holding the first edge 21 in the first retaining trough 122 to form an axis the support member 2 can be moved about the axis during installation to adjust the relative position with the positioning apparatus 1. Due to the axis formed by the first edge 21 and the first retaining trough 122 is close to the distal end of the anchor member 12 and the second anchor arm 13, the support member 2 can increase the stress withstanding capability of the anchor member 12 and the second anchor arm 13, and the structural strength thereof. All this makes positioning of the memory 4 easier. The card edge connector positioning apparatus of the invention also can resist deformation and reduce impact caused by tolerances.

While the preferred embodiment of the invention has been set forth for the purpose of disclosure, it is not the limitation of the invention. For instance the first edge 21 and second edge 22 of the support member 2 may be a boss or a sphere. Thus modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A card edge connector positioning apparatus located at two sides of a memory slot mounted onto a circuit board that is engageable with a memory that is inserted into the memory slot, comprising:

a first anchor arm;

a second anchor arm connected with the first anchor arm;

an anchor member fixed on the second anchor arm, the anchor member extending along an extending direction and having a distal end away from the memory slot, the distal end having a second aperture, one end of the first anchor arm deposed in the second aperture; and a support member, comprising:

a support portion, the support portion used for support the anchor member, the support portion having a fixing end for fixing the circuit board;

an extended portion, extended along the extending direction from the support portion, the extended portion pivoted with the distal end of the anchor member;

wherein the anchor member is rotated for changing the distance between the fixing end and the anchor member.

2. The card edge connector positioning apparatus of claim 1, wherein one end of the positioning apparatus is fixed with the memory slot.

3. The card edge connector positioning apparatus of claim 1, wherein the anchor member has a blocking portion for blocking the rotation of the support member.

4. The card edge connector positioning apparatus of claim 1, wherein the anchor member has a first retaining trough and a second retaining trough the first retaining trough is closer to a distal end of the positioning apparatus than the second retaining trough.

5. The card edge connector positioning apparatus of claim 4, wherein the extended portion has a first edge, the first edge is wedged in the first retaining trough to form a rotation axis of the support member.

6. The card edge connector positioning apparatus of claim 4, wherein the support portion has a second edge, the second edge is movably deposed in the second retaining trough.

7. The card edge connector positioning apparatus of claim 1, wherein the distal end of the anchor member has a transverse anchor element for fixing the memory.

8. The card edge connector positioning apparatus of claim 7, wherein the transverse anchor element is located in a notch of the memory while the memory is inserted in the memory slot.

9. The card edge connector positioning apparatus of claim 1, the support member is anchored between the second anchor arm and the anchor member to restrict a transverse displacement of the anchor member and the second anchor arm.

10. The card edge connector positioning apparatus of claim 1, wherein the second anchor arm has a second distal end which has a latch hook located thereon to latch the anchor member.

11. The card edge connector positioning apparatus of claim 10, wherein the distal end of the anchor member has a latch trough formed thereon to be latched by the latch hook to form anchoring.

12. The card edge connector positioning apparatus of claim 1, further comprising first anchor arm which is located an inner side of the second anchor arm, one end of the first anchor arm has a longitudinal retaining portion and a longitudinal support portion are located that form a space between them to hold the memory.

13. The card edge connector positioning apparatus of claim 12, wherein the first anchor arm is elastic and flexible and extendable outwards while the memory is inserted and depressed and returns to an original position after the memory has been moved to a regular connecting position to restrict a longitudinal displacement of the memory.

14. A card edge connector positioning apparatus located at two sides of a memory slot mounted onto a circuit board that is engageable with a memory that is inserted into the memory slot, comprising:

a second anchor arm;

a first anchor arm connected with the second anchor arm and located an inner side of the second anchor arm, one end of the first anchor arm has a longitudinal retaining portion and a longitudinal support portion are located that form a space between them to hold the memory;

an anchor member fixed on the second anchor arm, the an anchor member extending long an extending direction and having a distal end away from the memory slot; and a support member, comprising:

a support portion, the support portion used for support the anchor member, the support portion having a fixing end for fixing the circuit board;

an extended portion, extended along the extending direction from the support portion, the extended portion pivoted with the distal end of the anchor member;

wherein the anchor member is rotated for changing the distance between the fixing end and the anchor member.

15. The card edge connector positioning apparatus of claim 14, wherein the first anchor arm is elastic and flexible and extendable outwards while the memory is inserted and depressed and returns to an original position after the memory has been moved to a regular connecting position to restrict a longitudinal displacement of the memory.

* * * * *